US005782535A

United States Patent [19]

Lafer

[11] Patent Number: 5,782,535

[45] Date of Patent: Jul. 21, 1998

[54] ARMCHAIR

[75] Inventor: Percival Lafer, São Paulo - SP, Brazil

[73] Assignee: Lafer S/A. Indústria e Comércio, São Paulo, Brazil

[21] Appl. No.: 776,291

[22] PCT Filed: May 22, 1996

[86] PCT No.: PCT/BR96/00020

§ 371 Date: Feb. 27, 1996

§ 102(e) Date: Feb. 27, 1996

[87] PCT Pub. No.: WO96/37130

PCT Pub. Date: Nov. 28, 1996

[30] Foreign Application Priority Data

May 23, 1995 [BR] Brazil ..... 9502131

[51] Int. Cl.[6] ..... A47C 7/50; A47C 20/00

[52] U.S. Cl. ..... 297/423.36; 297/423.28; 297/423.3; 297/423.34; 297/68

[58] Field of Search ..... 297/326, 68, 69, 297/84, 423.3, 423.34, 423.36, 423, 28, 344.26, 344.21

[56] References Cited

U.S. PATENT DOCUMENTS

| | | | |
|---|---|---|---|
| 156,004 | 10/1874 | Waylard | 297/423.36 X |
| D. 179,969 | 4/1957 | Fidel | 297/423.3 X |
| 196,506 | 10/1877 | Vose | 297/423.34 |
| 403,318 | 5/1889 | Arnold | 297/423.36 X |
| 1,939,568 | 12/1933 | Danhorst | 297/423.3 X |
| 2,514,447 | 7/1950 | Hendrickson et al. | 297/423.28 X |
| 3,016,265 | 1/1962 | Cobb | 297/423.3 X |
| 4,264,103 | 4/1981 | Peresada et al. | 297/423.3 X |
| 4,674,794 | 6/1987 | Pine | 297/68 X |
| 4,678,229 | 7/1987 | Ryan et al. | 297/68 |
| 4,895,411 | 1/1990 | Pine | 297/68 X |
| 5,169,208 | 12/1992 | Re et al. | 297/68 X |
| 5,246,266 | 9/1993 | Ostergaard | 297/84 |
| 5,354,116 | 10/1994 | May et al. | 297/423.34 X |

FOREIGN PATENT DOCUMENTS

| | | | |
|---|---|---|---|
| 37 18 645 | 3/1988 | Germany . | |
| 5193409 | 8/1993 | Japan | 297/423.28 |

*Primary Examiner*—Peter M. Cuomo
*Assistant Examiner*—Rodney B. White
*Attorney, Agent, or Firm*—Darby & Darby

[57] ABSTRACT

An armchair, comprising: a base (10); a support frame (20), forming a framework to be fixed under the seat of an armchair portion (30); a footrest (40), comprising a first footrest portion articulated with the support frame (20), angularly displaceable between a non-operative position, inferiorly adjacent to the support frame (20), and an operative position projecting forwards from the armchair portion (30); and a second footrest portion (42, 420) mounted onto the first footrest portion (41), and linearly displaceable between a retracted position overlapped by the first footrest portion (41) and an extended position projecting therefrom; first impelling means (50), for promoting the angular displacement of the first footrest portion (41); and second impelling means (60, 600) promoting the linear displacement of the second footrest portion (42, 420) to and from its extended position in response to the respective angular displacement of the first footrest portion (41) to and from its operative position.

18 Claims, 7 Drawing Sheets

ARMCHAIR

FIELD OF THE INVENTION

The present invention refers to an armchair, of the type provided with a reclinable backrest and an articulated footrest, for home or office use, or further for use in transportation means, such as buses or airplanes.

BACKGROUND OF THE INVENTION

In similar armchairs of the state of the art, the footrests articulate between an operative or extended position, and a retracted position, where they project downwards, generally ortogonally from the armchair seat.

Such armchairs present several limitations. Firstly, the upright retracted position of their footrests is uncomfortable to the user, since it hinders the free movements of his feet.

A second shortcoming of these armchairs refers to the fact that their footrest retracting mechanism is coupled with the their backrest reclining mechanism, whereby the footrest will only be fully extended at the fully reclined position of the backrest. Consequently, at the intermediate reclining positions of the latter, the footrest is also at an intermediate position, which also makes its use very uncomfortable.

A third drawback of these known armchairs owes to the fact that their downward projecting footrests are considerably detrimental to the aesthetics of the assembly.

In a further aspect, the pendent footrest when use in the known armchairs in transportation means, such as airplanes, closes the space under the seat, usually used by the passengers to store personal luggage. Furthermore, the known armchairs are deficient regarding user's comfort: in their great majority, the adjustment of the backrest is only possible in predetermined positions, obtained through dented wheel mechanisms, where such positions do not usually coincide with the desired most comfortable position. The known millimetrically adjustable backrest armchairs generally use an endless screw mechanism, actuated by the user through rotating an actuator knob. This is a very uncomfortable operation to the user, inasmuch as it requires a large number of turns of said knob in order to displace the backrest along its entire course. Hence, it is a general object of the present invention to provide an armchair, of the type provided with an adjustable backrest and an articulated footrest, wherein said footrest,in a retracted position, does not interfere with the functionality and the aesthetics of the armchair.

It is a particular object of the present invention to provide an armchair, as described above, which permits the user to combine any possible position of the backrest with a comfortable position of the footrest.

It is also an object of the present invention to provide an armchair, as described above, the footrest position of which, in its retracted position, permits free movements of the user's feet, thus providing for a comfortable seat.

It is also a further object of the present invention to provide an armchair, as described above, extremely versatile, due to the layout of its footrest in a retracted position, making it adequate for use in transportation means, such as airplanes, as well as in non-vehicular uses, such as in homes, offices, auditoriums, among others.

It is an additional object of the present invention to provide an armchair, as described above, carrying a backrest millimetrically adjustable through a mechanism extremely simple and comfortable to the user.

SUMMARY OF THE INVENTION

These and other objects and advantages of the present invention are attained through the provision of an armchair, comprising: a base; a support frame, forming a framework to be fixed under the seat of an armchair portion.

According to the invention, the armchair is provided with: a flat frame-shaped footrest, comprising: a first footrest portion, rearly articulated with the forelower region of the support frame, in order to be angularly displaced between a non-operative position, inferiorly adjacent to the support frame, and an operative position projecting forwards from the armchair portion; and a second footrest portion mounted onto the first footrest portion, to be linearly displaceable between a retracted position overlapped by the first footrest portion and an extended position projecting forwards from a fore edge of the first footrest portion; guiding means, mounted on the first footrest portion for guiding the linear displacement of the second footrest portion; first impelling means, mounted on the support frame, operatively connected to the first footrest portion and selectively actuated to displace the latter between its operative and nonoperative positions; and second impelling means, comprising an arm medianly articulated with the first footrest portion, having an end articulated with the second footrest portion, and an opposite end, operatively connected to the support frame in order to automatically promote the linear displacement of the second footrest portion to and from its extended position in response to the respective angular displacement of the first footrest portion to and from its operative position.

In practical terms, the armchair of the invention is extremely versatile: thanks to the retracted position of its footrest, inferiorly settled against its support frame, said armchair permits free movements of the user's feet, whereby to permit him to at any time find a comfortable upright sitting position.

In a second aspect, since the proposed armchair presents independent mechanisms for driving the footrest retraction and the backrest reclining, at any position chosen by the user for the backrest, the footrest can selectively be used or not and, when in use, shall always be in its fully extended,most comfortable position.

An additional positive feature of the armchair of the invention refers to its backrest reclining mechanism, which permits millimetrical adjustment, through an extremely simple and effective construction, providing easy and comfortable operation to the user.

BRIEF DESCRIPTION OF THE DRAWINGS

The invention shall now be described in relation to the attached drawings, wherein.

BEST MODE FOR CARRYING OUT THE INVENTION

Figure 1:
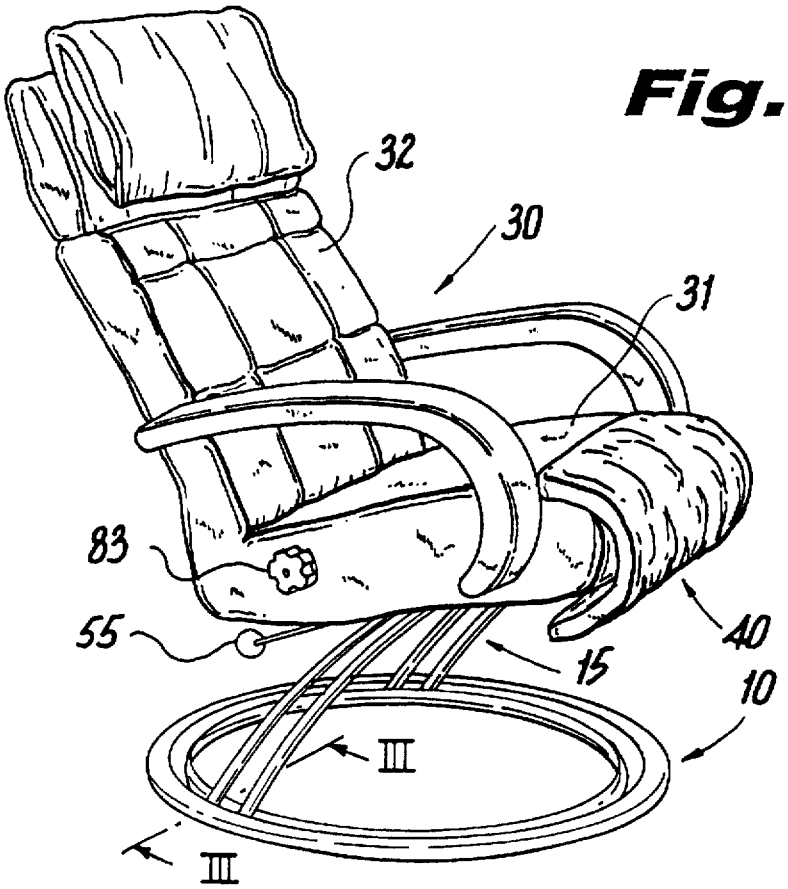
FIG. 1 represents a front-lateral perspective view of an armchair of the invention, at its upright position.
Figure 2:
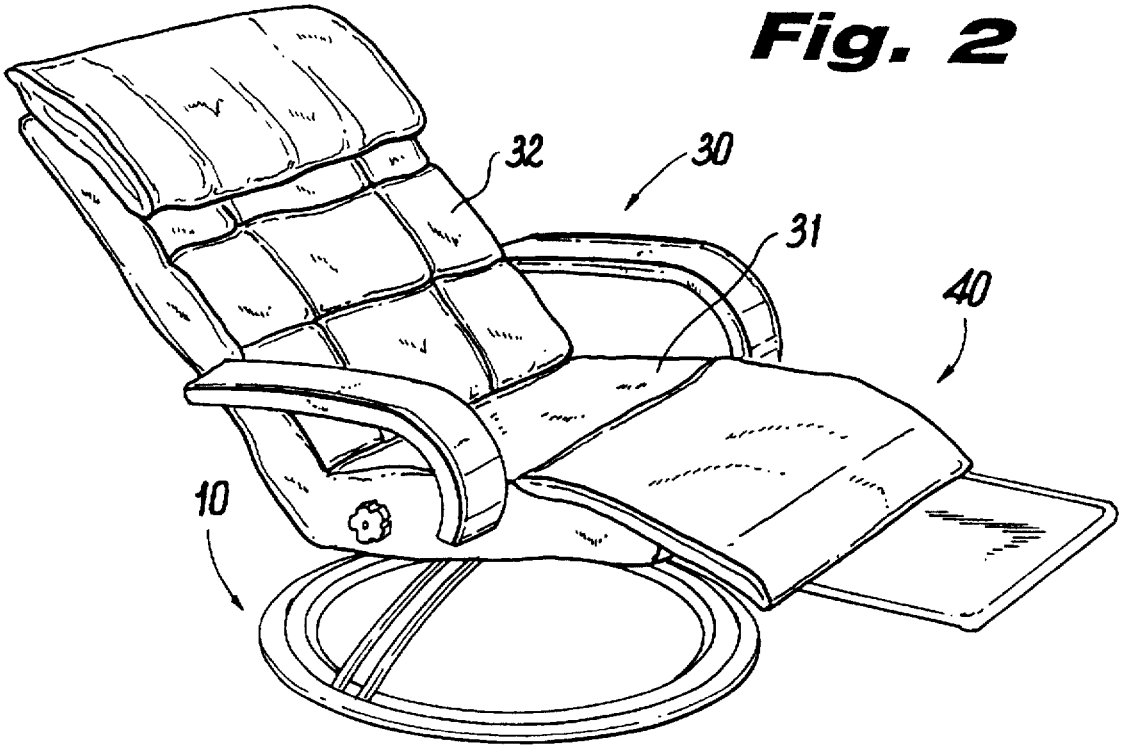
FIG. 2 represents a similar view to FIG. 1, however showing the armchair at its reclined position, with its footrest portion extended.
Figure 3:
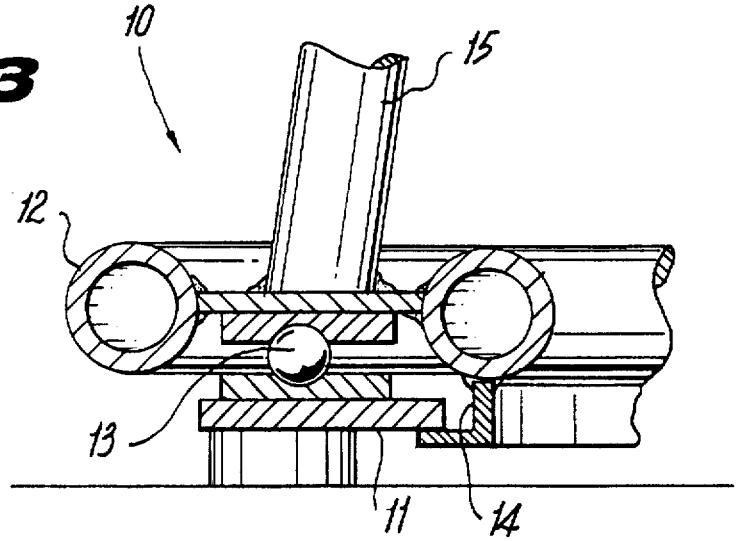
FIG. 3 represents a cross-sectional view of the base of the armchair, taken along line III—III shown in FIG. 1.
Figure 4:
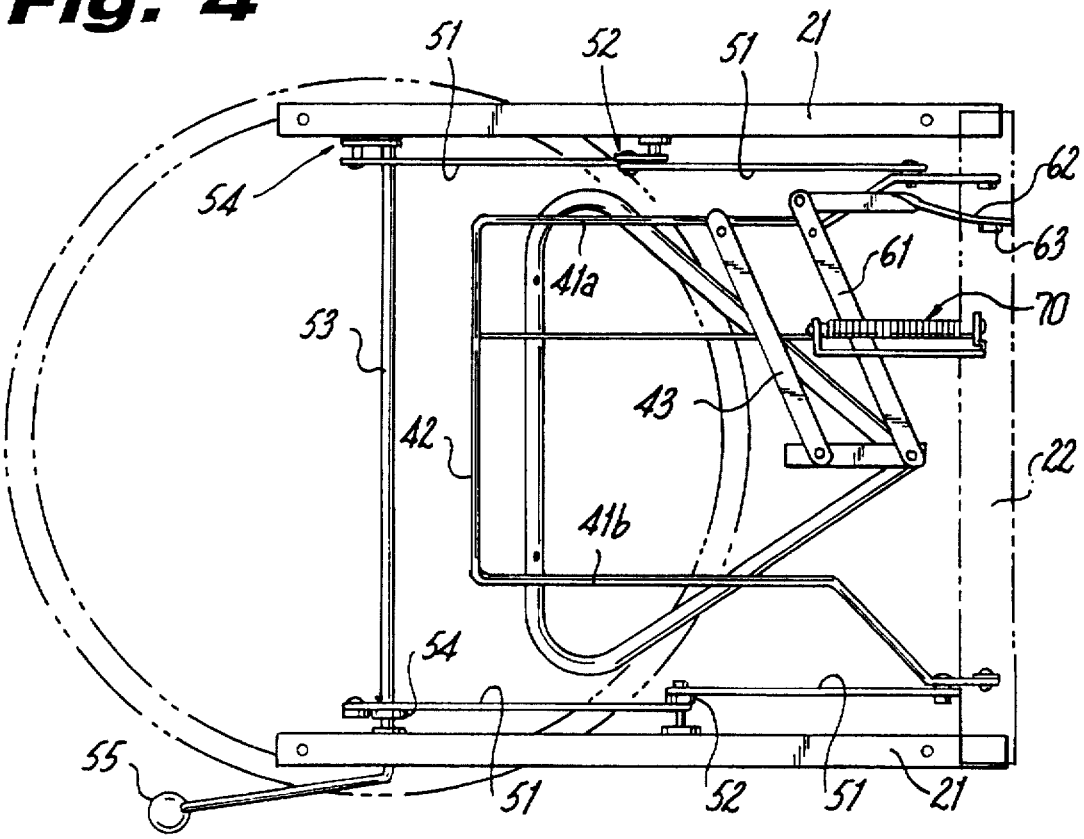
FIG. 4 represents a top plan view of the one embodiment footrest actuating mechanism of the armchair at the retracted position of the armchair's footrest portion.
Figure 5:
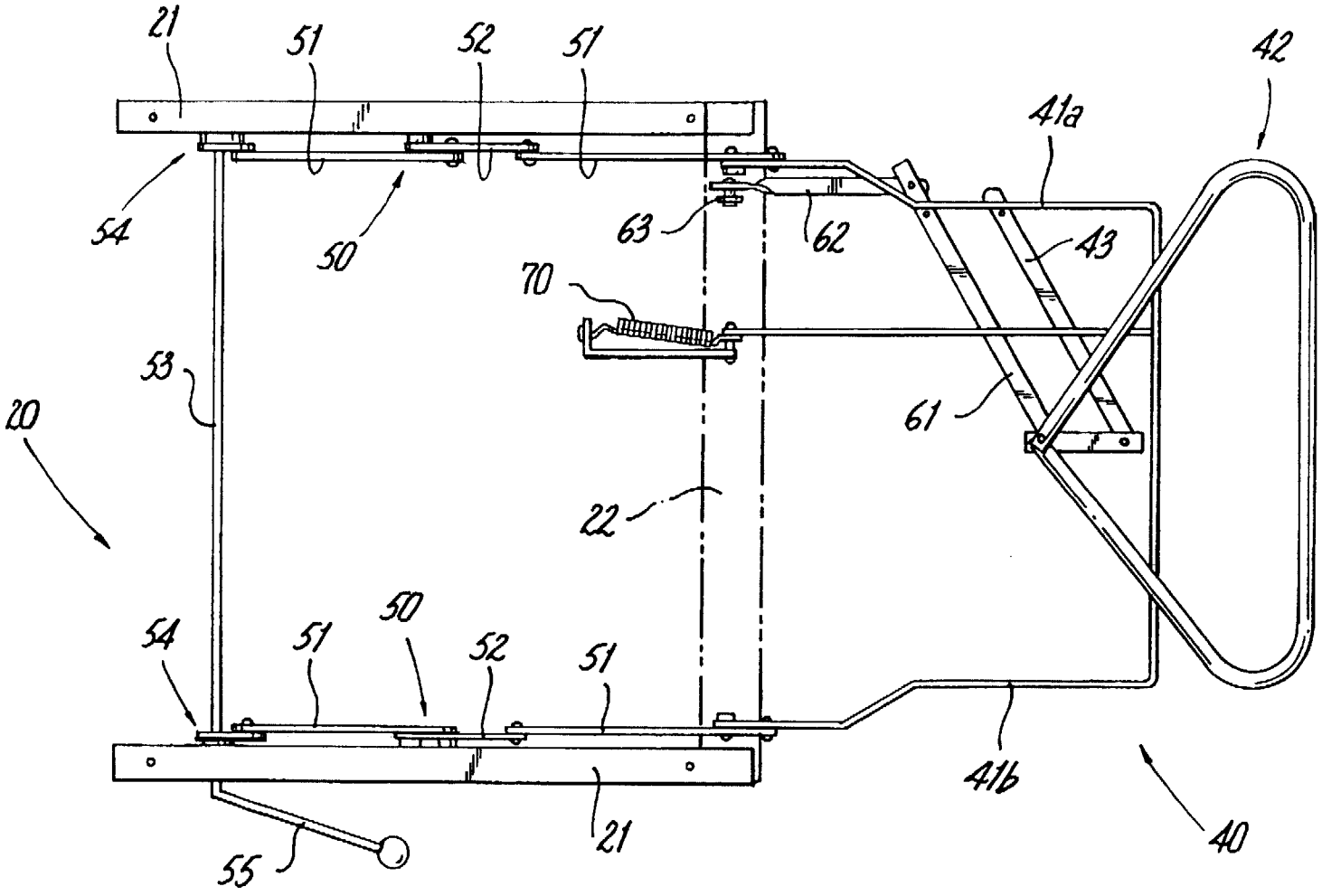
FIG. 5 represents a view similar to that of FIG. 4, however at the extended position of the armchair's footrest portion.

According to the above described figures, the armchair of the invention comprises: a base 10; a support frame 20 consisting of at least two longitudinal bars 21 and at least one crossbar 22 and a shaft 53 in place of a second crossbar forming a framework to be mounted onto said base 10, and onto which is fixed an armchair portion 30.

In the preferred embodiment of the invention, base 10 is circular, comprising a lower annular "U" cross-sectioned rail 11, and an upper annular rail 12 mounted over a plurality of spheres 13 provided within said lower rail 11, whereby to permit the armchair to rotate. Upper annular rail 12 further incorporates two diametrically opposed column assemblies 15, onto which is then mounted support frame 20. The latter preferably consists of two longitudinal bars 21, one fore crossbar 22 and, rearly, a crossbar is replaced with a shaft 53, for actuating the operating mechanism of a footrest 40.

Footrest 40 comprises a first footrest portion 41, fine, flat frame-shaped, preferably generally "U"-shaped, rearly articulated at the free ends thereof, below crossbar 22, through a first pair of pivots 44, whereby to angularly oscillate between a non-operative position, inferiorly and adjacent to support frame 20, and an operative position, and forwards projecting from armchair portion 30. In order to permit the insertion of said first footrest portion 41 under support frame 20, without interfering with the operating mechanism of said footrest 40, said first footrest portion 41 is narrowed forwards from a median region thereof. In order to permit free angular displacement of first footrest portion 41, without the interference of base 10, the length of the former is slightly less than the distance between the first footrest portion axis and said base 10.

Footrest 40 further includes a second footrest portion 42,420, comprising a flat frame, substantially parallel with and mounted onto first footrest portion 41, in order to be displaceable along the latter, simultaneously with the angular movement thereof, between a non-operative position, seated against said first footrest portion 41 and overlapped by the latter when at its non-operative position,and an operative position, linearly displaced forwards, from a fore edge of first footrest portion 41, at the operative position of the latter, said linear displacement being guided by guiding means 43, 430, the latter further comprising the mounting element of second footrest portion 42,420 onto first footrest portion 41.

Second footrest portion 42, 420 acts further as support for the footrest upholstery. As such, the upholstery may either be fixed directly onto the same, an upholstered plate may be fixed thereon, or an extension of the upholstery of the armchair may be fixed onto said second footrest portion 42, 420.

Figure 6:
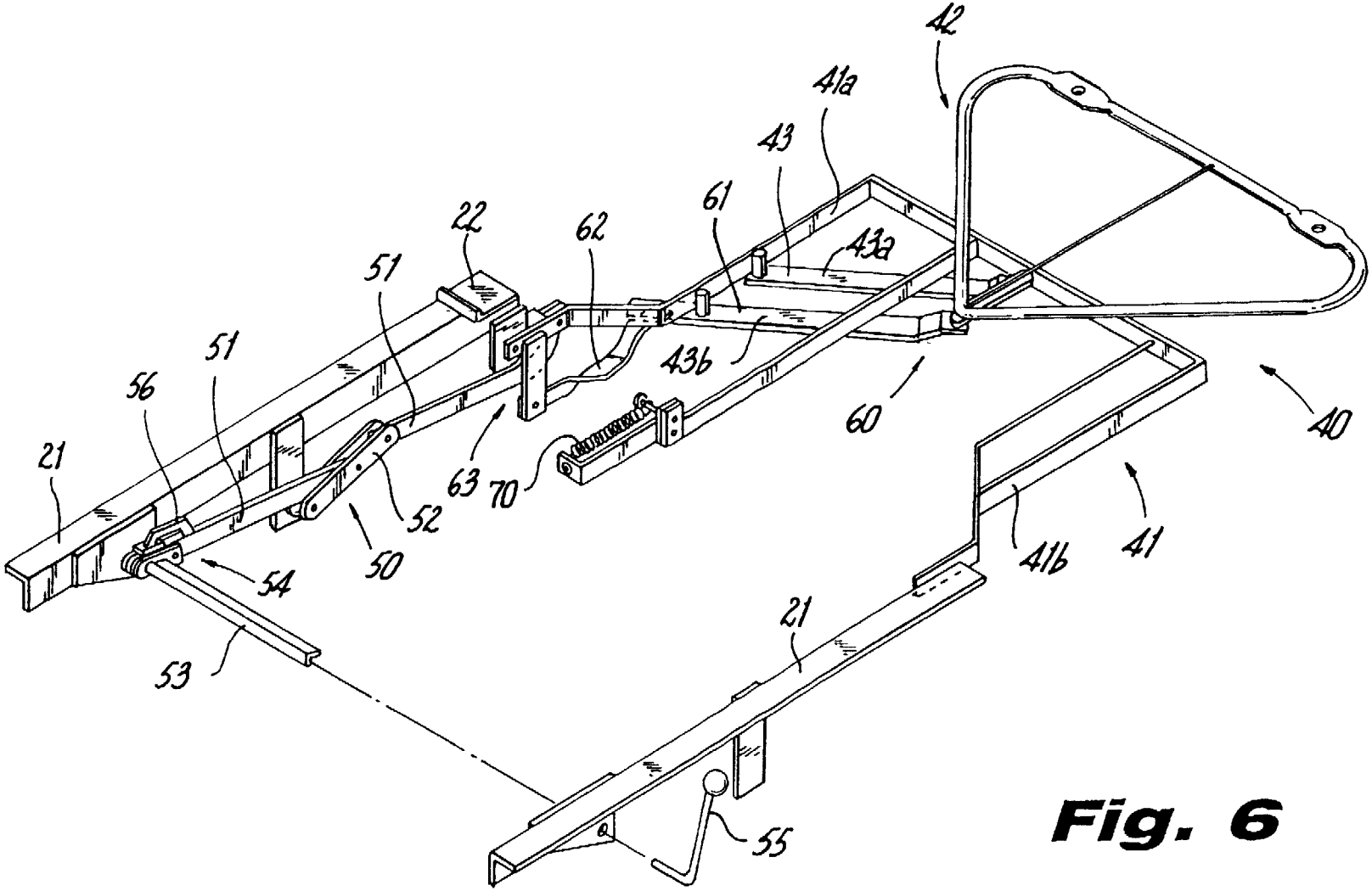
FIG. 6 presents a rear-lateral perspective view of the footrest actuating mechanism of FIGS. 4 and 5, at the extend position thereof.

In a first embodiment, best illustrated in FIG. 6, guiding means 43 comprises a pair of parallelogrammic arms 43., the rear ends of fore articulating arm 43*a* and rear articulating arm 43*b* thereof being articulated with a median region of a first side bar 41*a* of first footrest portion 41, the fore ends of said fore and rear articulating arms 43*a*, 43*b* being articulated with a rear median region of second footrest portion 42.

Figure 7:
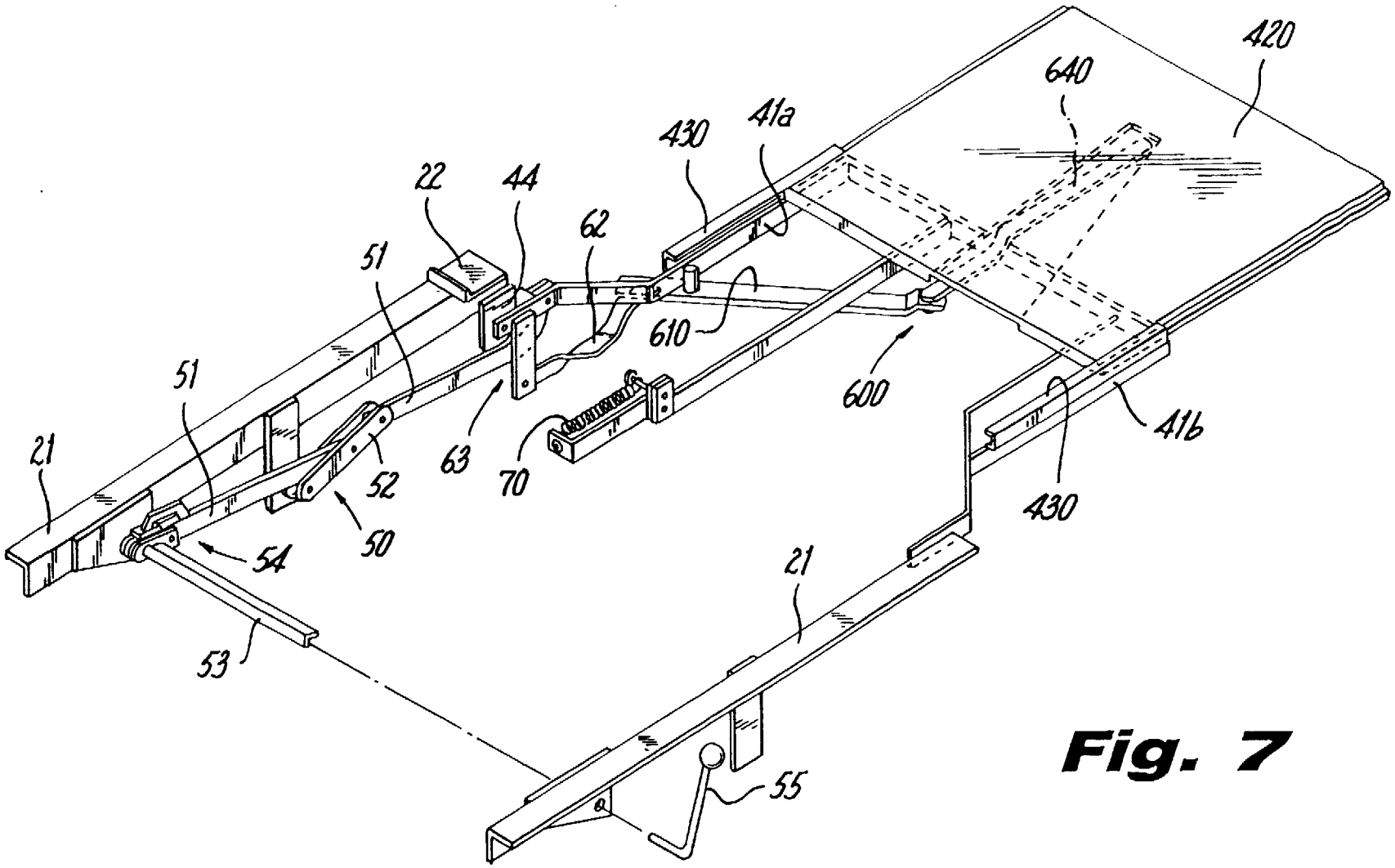
FIG. 7 represents a similar view to that of FIG. 6, of a further embodiment of the footrest actuating mechanisms of the armchair of the invention.
Figure 8:
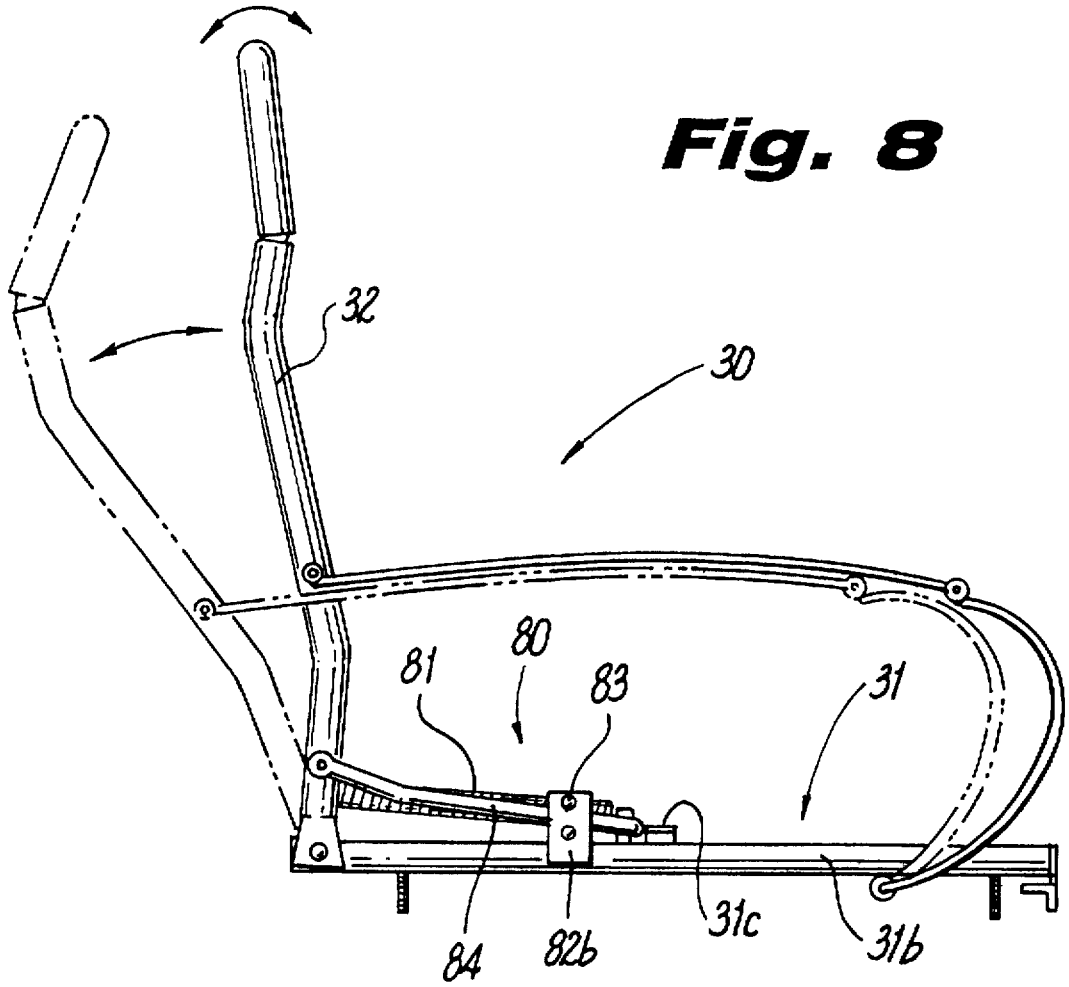
FIG. 8 represents a side view of the armchair portion of th armchair of the invention, showing its backrest adjustment mechanism, and in phantom, said backrest at its reclined.
Figure 9:
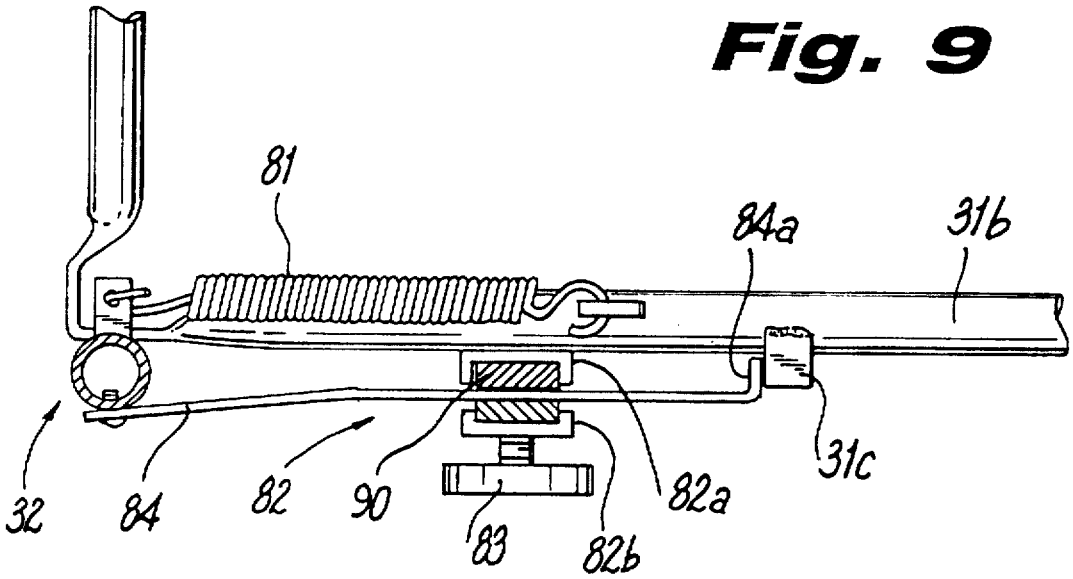
FIG. 9 represents an enlarged and partially sectioned top plan view of the backrest adjustment mechanism illustrated in FIG. 8.
Figure 10:
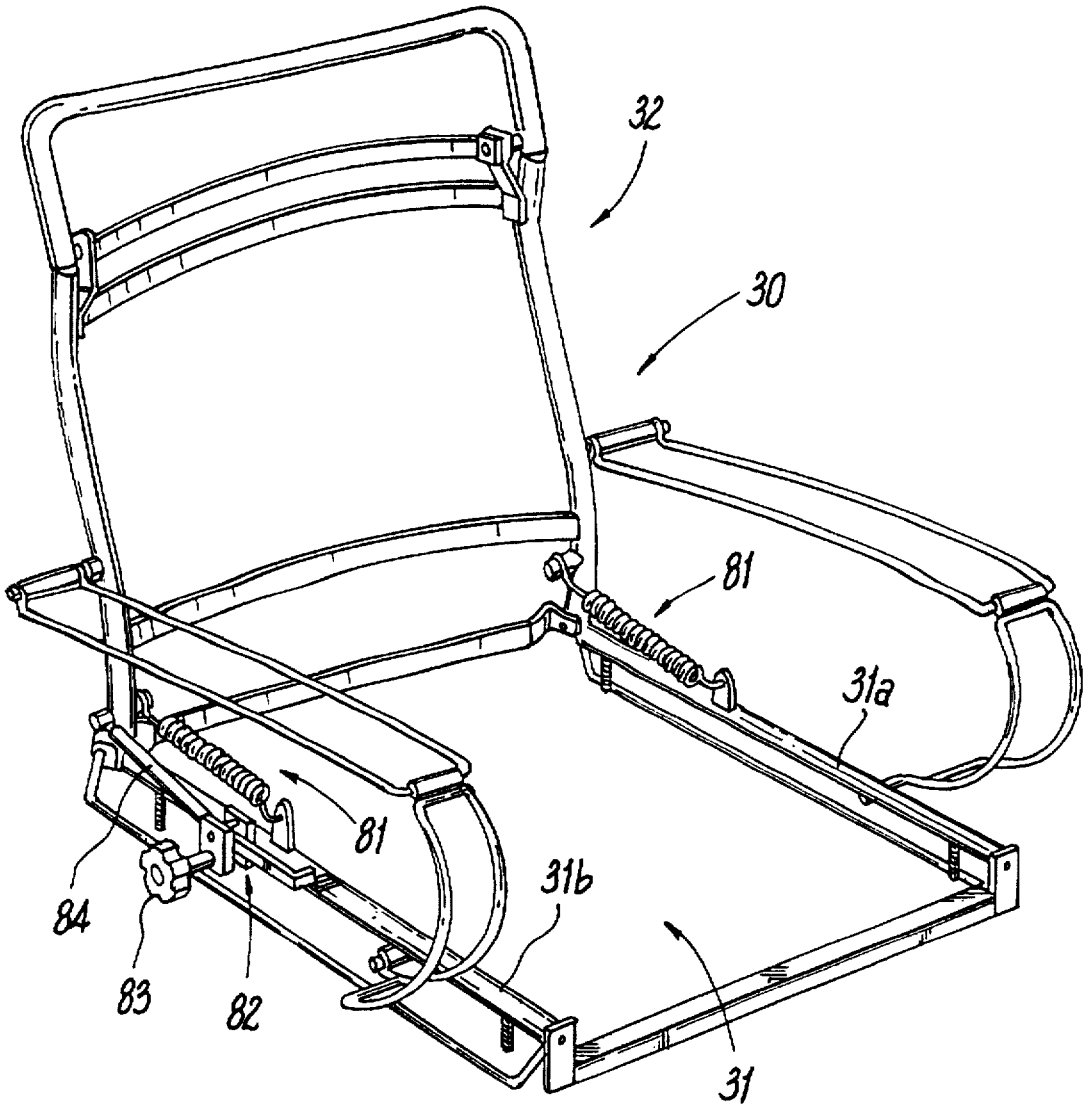
FIG. 10 represents a front-lateral perspective view of the armchair portion illustrated in FIG. 8.

In a second embodiment, as shows FIG. 7, guiding means 430 comprises a pair of rails, fixed to corresponding side bars 41*a*, 41*b* of first footrest portion 41, in order to receive and guide therebetween the second footrest portion 420.

In order to displace first footrest portion 41, first impelling means 50 is provided, comprising two bisected first levers 51, each being forely articulated with a corresponding rear side border of first footrest portion 41, and rearly articulated at a rear articulating arm 54 fixed onto actuating shaft 53, the adjacent ends of each bisected lever 51 being articulated with an intermediate articulating arm 52, with an end pivoted to a corresponding longitudinal bar 21 of support frame 20, in order to produce a linear displacement of the fore end of first lever 51, and displacing first footrest portion 41 therewith, in response to a rotation of said shaft 53, actuated by the user through a side lever 55, attached to the latter.

In another embodiment of the invention, not illustrated, impelling means 50 can comprise an electric motor, a hydraulic and/or pneumatic impeller, or the like, however preferably actuating on intermediate articulating arm 52.

The displacement of said first footrest portion 41 is limited by a pair of stops 56, fixed onto shaft 53, each sitting on an adjacent portion of a corresponding first lever 51, at an extended condition thereof, corresponding to the extended position of first footrest portion 41.

In another embodiment, not illustrated, the impelling means 50 may comprise a single first lever 51, however making the actuation of the mechanism harder.

In a further embodiment, not illustrated,first levers 51 can be in single parts, however, also in this case, at the cost of an undesirably harder actuation.

In a third non-illustrated embodiment,first levers 51 may be multisected, having two or more intermediate articulating arms: in this case, the gain in operational smoothness does not compensate the increase in complexity and cost of such a construction.

The second footrest portion 42,420 is displaced through a second impelling means 60,600, comprising a rod 61,610. In the first illustrated embodiment, where the guiding means of second footrest portion 42 is the parallelogrammic joint 43, the rod 61 is incorporated to the rear end of rear articulating arm 43b of the latter.

In order to obtain the displacement of second footrest portion 42, 420, in response to the angular displacement of first footrest portion 41, the second impelling means 60, 600 further comprises a stem 62, articulating forely and horizontally with the rear end of rod 61, 610, and rearly and vertically with the free end of a vertical, downwards projecting spacer support 63, laterally fixed to the first footrest portion 41.

In order to provide a downwards directed force component, necessary at the start of the angular displacement of first footrest portion 41, stem 62 is arcuate downwards. The spacing provided between support frame 20 and the rear joint of said stem 62 by spacer support 63 is that adequate to result in substantial coplanarity of the fore articulating end of the former and the rear articulating end of rod 61, 610.

In this first embodiment of the invention, which includes the pair of parallelogrammic arms 43, the second footrest portion 42 can be in the form of a frame or a plate, presenting any shape, as long as the following dimensional limitations are respected: longitudinally, it should not be larger than first footrest portion 41, so that no interference occurs between footrest 40 and the floor, during displacements of said footrest 40; and, laterally, the maximum dimension thereof must be such that no interference occurs between footrest 40 and the retraction mechanism thereof, during retraction operations, and further considering a slight arcuate transverse motion effected by second footrest portion 42, when arriving and leaving from its operative position.

In the second embodiment of the invention, where the guiding means of second footrest portion 420 is defined by a pair of rails 430, as shown in figure, the second impelling means 600 comprises a rod 610, constructively similar to the rear articulating arm 43*b*/rod 61 assembly of the above-described embodiment. However, due to the fact that the pair of rails 430 does not permit the transverse clearance motion of said second footrest portion 420, such a clearance motion is effected through an oscillating rod 640, rearly articulated with rod 610, and forely and inferiorly articulated with a fore-median region of said second footrest portion 420, in order the rear portion of said oscillating rod 640 effects said transverse clearance motion, substantially equal in amplitude with the arcuate motion of second footrest portion 42. Since all the further elements are identical in both second impelling means embodiments 60, 600, no further description thereof is necessary.

In this second embodiment, second footrest portion 420 must be slightly narrower than the distance between the intermediate projections of rails 430, and a lateral thickness slightly less than the apertures thereof, in order to be easily insertible into and freely displaceable along said rails 430. Satisfying the above-mentioned length and thickness dimensional limitations, second footrest portion can incorporate the additional constructive alternatives for second footrest portion 42.

The footrest 40 retracting mechanism of the armchair further includes a device for retaining the first footrest portion 41 at its non-operative and operative positions, comprising a spring 70, fixed to support frame 20 and first footrest portion 41, in order to be stretched to a maximum length when the latter passes the intermediate position between its non-operative and operative positions, regaining its retracted condition and thereby stabilizing said first footrest portion 41 at said positions.

The armchair portion 30 of the armchair of the invention comprises a seat frame 31, to be fixed onto support frame 20, and including a pair of seat longitudinal bars 31, 31*b*, with the rear ends of which is articulated a backrest frame 32, reclinable through a backrest adjusting mechanism 80 which comprises: back positioning means 81, preferably defined by at least one, and more preferably by two extension springs 81, each being rearly fixed to backrest frame 32, and forely, to the median region of the adjacent seat longitudinal bar 31*a*, 31*b*, permanently stretched, in order to constantly force said backrest frame 32 to its resting position, upright. Said backrest adjustment mechanism 80 further comprises jaw means 82, fixed to one of seat longitudinal bars 31*a*, 31*b*, actuated by a screwable knob 83, to selectively bring said jaw means 82 from a released condition to a locked condition and from the latter to the former condition; and a backrest adjustment arm 84, preferably flat blade-shaped, rearly articulated with the backrest frame 32, and forely provided with and inwards directed substantially 90° projection 84*a*, slideably seated on seat longitudinal bar 31*a*, 31*b*, in such a way that backrest adjustment arm 84 be displaced within jaw means 82, being selectively locked and released, at corresponding locked and released conditions of jaw means 82.

Through the above described mechanism, the armchair user unscrews knob 83, releasing backrest adjustment arm 84 from jaw means 82, forces the backrest backwards until the desired position, screws back knob 83, in order that jaw means 82, gripping said adjustment arm 84, retain the armchair backrest at the desired position. The release of knob 83, without the interference of the user's body, shall result in the return of the backrest to its upright position, driven by springs 81.

The perfect locking of backrest adjustment arm 84 by jaw means 82 is obtained through the lining of the facing surfaces of the latter with a break-lining material, such as a fiber-phenolic resin material.

I claim:

1. An armchair, comprising: a base; a support frame, forming a framework to be fixed under a seat of an armchair portion, wherein the armchair is provided with: a footrest, comprising: a first footrest portion including a rear portion articulated with the support frame, in order to be angularly displaced between a non-operative position adjacent to the support frame, and an operative position projecting forwardly from the armchair portion; and a second footrest portion mounted onto the first footrest portion, to be linearly displaceable between a retracted position overlapped by the first footrest portion and an extended position projecting forwardly from said first footrest portion; guiding means mounted on the first footrest portion for guiding the linear displacement of the second footrest portion; first impelling means, mounted on the support frame, operatively connected to the first footrest portion and selectively actuated to displace the first footrest portion between its operative and non-operative positions; and second impelling means comprising a rod medially articulated with the first footrest portion, having an end articulated with the second footrest portion, and an opposite end operatively connected to the support frame in order to automatically promote the linear displacement of the second footrest portion to and from its extended position in response to the respective angular displacement of the first footrest portion to and from its operative position.

2. The armchair according to claim 1, wherein the guide means comprises an arm arranged in parallelogramic relationship with the rod and having its opposite ends respectively articulated with a medial region of a first side bar of the first footrest portion, and with a rear medial region of the second footrest portion.

3. The armchair according to claim 1, wherein the guide means comprises a pair of rails fixed to corresponding side bars of the first footrest portion.

4. The armchair according to claim 1, wherein the first impelling means comprises at least one first lever including a first end that is articulated with a medial point of the first footrest portion and including a rear end being operatively connected to an actuation means so that, upon its actuation, the first footrest portion is angularly displaced.

5. The armchair according to claim 4, wherein the first impelling means comprises two bisected levers, each including a first end articulated with the first footrest portion, and each including a second end articulated with a rear articulating arm fixed to the actuating means.

6. The armchair according to claim 5, wherein the displacement of the first footrest portion is limited by a pair of stops, fixed to the actuating means, each sitting on an adjacent portion of a corresponding first lever in an extended condition, corresponding to the extended position of the first footrest portion.

7. The armchair according to claim 1, wherein the opposite end of the arm is articulated with a first end of a stem, the stem including an opposite end that is articulated under the support frame.

8. The armchair according to claim 7, wherein the first end of the stem is articulate with the rear end of the rod, and the opposite end is aritculated with a downwardly projecting spacer support, laterally fixed to the first footrest portion.

9. The armchair according to claim 1, and further comprising a spring, fixed to the support frame and to the first footrest portion, in order to present maximum extension when the first footrest portion passes by the intermediate position between the non-operative and operative positions thereof, returning to its retracted position at the non-operative and operative positions.

10. The armchair according to claim 1, wherein the armchair comprises a seat frame, articulated with a backseat frame, and carrying jaw means provided with a screwed knob, in order to selectively lock or release a flat stem displaceable with said jaw means.

11. An armchair, comprising:

a base;

a support frame attached to the base and forming a framework to be fixed under a seat of an armchair portion;

a footrest comprising a first footrest portion articulated with the support frame and displaceable between non-operative and operative positions, and a second footrest portion mounted onto the first footrest portion to be linearly displaceable between a retracted position overlapped by the first footrest portion and an extended position projecting forwardly from said first footrest portion; and an impelling rod medially articulated with the first footrest portion, having a first end articulated with the second footrest portion, and a second end operatively connected to the support frame in order to automatically promote the linear displacement of the second footrest portion to and from its extended position in response to respective angular displacement of the first footrest portion to and from its operative position.

12. The armchair of claim 11 and further including:

guiding means mounted on the first footrest portion for guiding the linear displacement of the second footrest portion between the retracted and extended positions.

13. The armchair of claim 11 and further including:

impelling means mounted on the support frame, operatively connected to the first footrest portion, and selectively actuated to displace the first footrest portion between its operative and non-operative positions.

14. The armchair according to claim 13, characterized in that the impelling means comprises at least one first lever including a first end that is articulated with a medial point of the first footrest portion and including a rear end being operatively connected to an actuating means so that, upon its actuation, the first footrest portion is angularly displaced.

15. The armchair according to claim 13, characterized in that the impelling means comprises at least two bisected levers, each including a first end articulated with a corresponding rear side border of the first footrest portion, and each including a second end articulated with a rear articulating arm fixed to actuating means defined by a shaft with adjacent ends that are articulated with an intermediate articulating arm being articulated under a corresponding longitudinal bar of the support frame.

16. The armchair according to claim 11, characterized in that the second end of the rod is articulated with a first end of a stem, the stem including an opposite end that is articulated under the support frame.

17. The armchair according to claim 16, characterized in that the stem includes a first end articulated with the second end of the rod, and includes a second end articulated with a downwardly projecting spacer support, laterally fixed to the first footrest portion.

18. The armchair according to claim 11 and further comprising:

a spring fixed to the support frame and to the first footrest portion in order to present maximum extension when the first footrest portion passes by the intermediate position between the non-operative and operative positions thereof, returning to its retracted position at the non-operative and operative positions.

* * * * *